US005485652A

United States Patent [19]

Holland

[11] Patent Number: 5,485,652

[45] Date of Patent: Jan. 23, 1996

[54] SUCTION CLEANING HEAD

[75] Inventor: John A. Holland, Winthrop, Australia

[73] Assignee: VAX Appliances Ltd., United Kingdom

[21] Appl. No.: 987,268

[22] PCT Filed: Oct. 2, 1991

[86] PCT No.: PCT/AU91/00448

§ 371 Date: Mar. 4, 1993

§ 102(e) Date: Mar. 4, 1993

[87] PCT Pub. No.: WO92/05735

PCT Pub. Date: Apr. 16, 1992

[30] Foreign Application Priority Data

| | | | |
|---|---|---|---|
| Oct. 2, 1990 | [GB] | United Kingdom | 9021388 |
| Mar. 20, 1991 | [AU] | Australia | PK5188 |
| Mar. 25, 1991 | [AU] | Australia | PK5251 |

[51] Int. Cl.[6] ..... A47L 11/30; A47L 7/00

[52] U.S. Cl. ..... 15/322; 15/415.1

[58] Field of Search ..... 15/321, 322

[56] References Cited

U.S. PATENT DOCUMENTS

| | | | |
|---|---|---|---|
| 3,747,155 | 7/1973 | Koellisch | 15/321 X |
| 4,095,309 | 6/1978 | Sundheim | 15/321 X |
| 4,137,600 | 2/1979 | Albishausen | 15/322 |
| 4,488,330 | 12/1984 | Grave | 15/322 |
| 4,654,925 | 4/1987 | Grave | 15/322 |
| 4,879,784 | 11/1989 | Shero | 15/322 |
| 5,001,806 | 3/1991 | Gurstein | 15/322 |

FOREIGN PATENT DOCUMENTS

| | | |
|---|---|---|
| 1121225 | 7/1968 | United Kingdom . |
| 1291138 | 9/1972 | United Kingdom . |
| 1601455 | 10/1981 | United Kingdom . |
| 8904627 | 6/1989 | WIPO . |
| 8904626 | 6/1989 | WIPO . |
| 9003142 | 4/1990 | WIPO . |

*Primary Examiner*—Chris K. Moore
*Attorney, Agent, or Firm*—Spencer & Frank

[57] ABSTRACT

A suction cleaning head (10) characterised in that it comprises a suction chamber (12) having an open mouth (36) and an outlet (40) adapted to be connected to an air extraction means, a cleaning liquid chamber (14) located at a point external to the suction chamber (12) and having an open mouth (63) and an outlet (62) adapted to be connected to a supply of cleaning liquid, a flow restricting means (16) adapted to engage the open mouth (63) of the cleaning liquid chamber (14), and a plurality of passageways (78, 122, 192) to enable transfer of cleaning liquid from the cleaning liquid chamber (14) through or past the flow restricting means (16).

24 Claims, 14 Drawing Sheets

FIG. 14
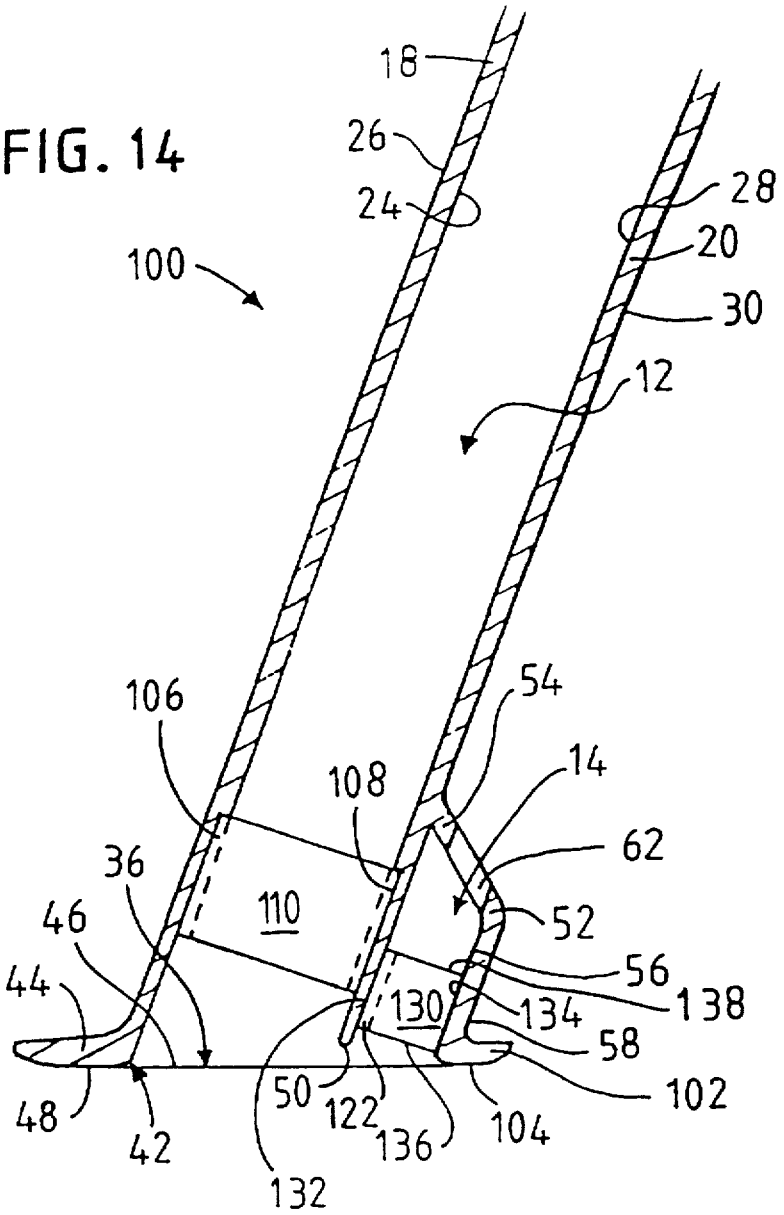
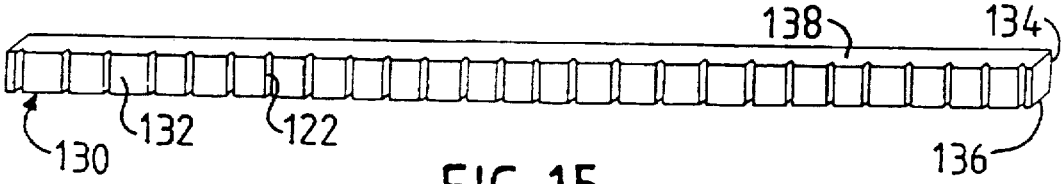
FIG. 15

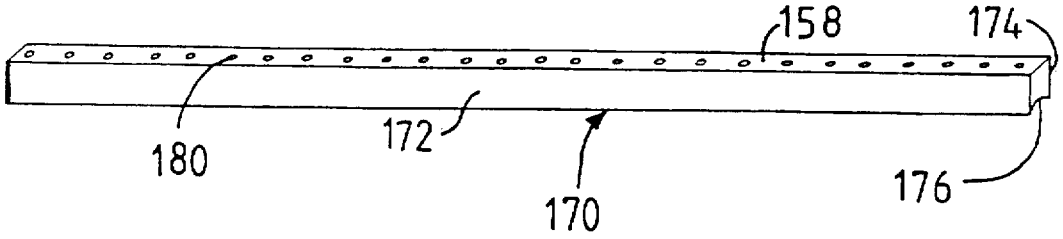
FIG. 19
FIG. 20
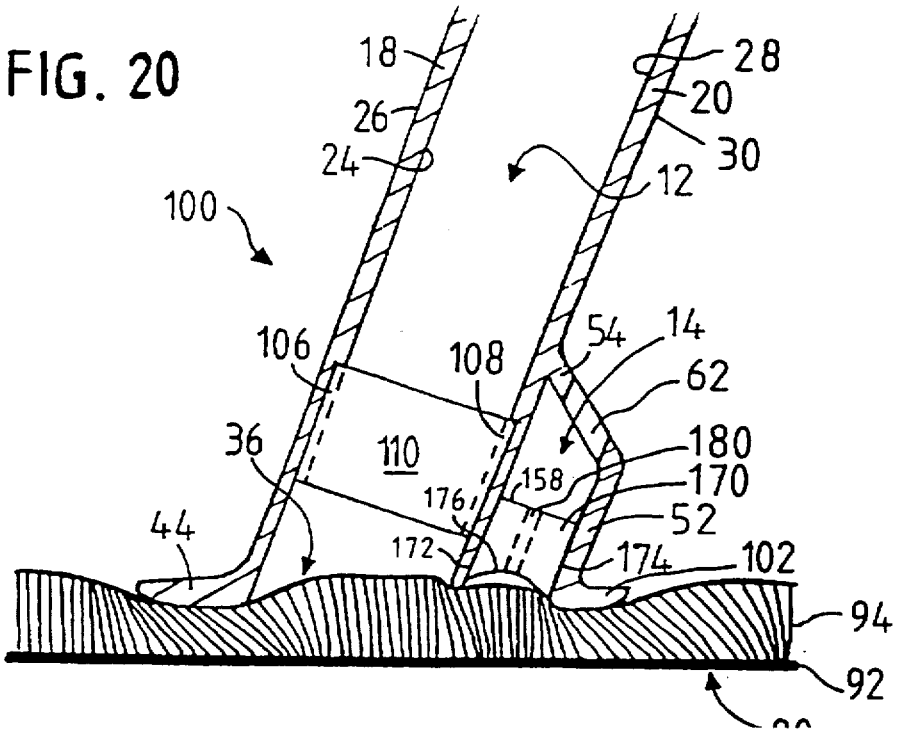

SUCTION CLEANING HEAD

DESCRIPTION

The present invention relates to a suction cleaning head. More particularly, the present invention relates to a suction cleaning head intended for use with wet suction apparatus to clean carpets and other natural and synthetic floor coverings including pile type rugs, upholstery and the like.

FIELD OF THE INVENTION

Typically, one form of wet suction cleaning apparatus presently in use to clean carpets, floor coverings, upholstery and the like is known as a hot water extraction cleaner or carpet steam cleaner. Such apparatus typically comprises a spray type cleaning head which is connected by a flexible suction hose to a source of suction capable of recovering and storing liquids with the dirt or soils in suspension from the surfaces being cleaned. Such apparatus also comprises a separate cleaning liquid tank which is fitted with a high pressure pump such that cleaning liquids at various required temperatures may be sprayed onto the surface being cleaned via jets generally located behind the cleaning head and connected to this pump with a pressure hose.

The typical spray type cleaning head used in conjunction with this type of apparatus is often triangular in shape when viewed from the front or rear and enclosed at the sides to form an open mouth suction chamber with a tubular outlet at the top. This outlet is connected to a suction source through a hollow handle and a flexible vacuum hose. A separate pressure hose carries cleaning liquids at various required temperatures to jets located behind the head that deliver a fan shaped spray to the surface being cleaned. The supply of cleaning liquid is regulated manually by an operator controlled on/off valve. Generally the operator sprays cleaning liquid onto the surface being cleaned whilst moving the cleaning head forward in an outward stroke. Then with the control valve off, the operator draws the cleaning head backwards to suck up dissolved dirt or soils. In the case of a carpeted floor surface, the operator generally exerts a downward pressure on the cleaning head during the backward stroke which assists suction recovery by squeezing surplus cleaning liquid from the carpet fibres.

A difficulty with these spray type cleaning heads is the possibility of overwetting the surface being cleaned causing shrinkage, staining or prolonged drying as the flow of cleaning liquid must be regulated manually using the on/off valve and it is possible for an inexperienced operator to miscalculate the quantity of cleaning liquid required.

An additional difficulty occurs when higher temperature cleaning liquids are required with spray type cleaning heads to accelerate the cleaning action on exceptionally dirty or greasy surfaces. This difficulty is due to the reduction in temperature that occurs as the cleaning liquid is discharged to atmosphere prior to coming into contact with the surface being cleaned. The jets are mounted well above the surface for effective spray coverage which aggravates the cooling problem.

A further difficulty with spray type cleaning heads is that they have a very narrow opening between the front and back walls of the suction mouth, typically 6 mm across the entire width of the suction chamber, so that negligible downward force occurs due to atmospheric pressure when air is evacuated from within the head during the cleaning of carpeted floor surfaces. Any downward force needed to squeeze surplus cleaning liquid from carpet fibres must be provided by the operator. This is tiring and uneven pressure may cause damage to older carpets.

A still further difficulty is the substantial cost of high pressure pumps required to deliver cleaning liquid to the jets behind spray type cleaning heads and the problem of maintenance if a pump runs dry or a blockage occurs.

Another form of wet suction cleaning apparatus is disclosed in United Kingdom Patent Application Nos. 1,121,225 and 1,291,138 which operates in a similar manner to the more common form of hot water extraction cleaner or carpet steam cleaner but without a high pressure pump. This apparatus utilizes suction means to supply and remove cleaning liquid from the surface being cleaned. This form of apparatus incorporates a suction type cleaning head, an example of which also is disclosed. Further suction type cleaning heads are disclosed in International Patent Application Nos. PCT/AU88/00446 and PCT/AU88/00447.

A difficulty with the suction type cleaning head or nozzle disclosed in United Kingdom Patent Application Nos. 1,121,225 and 1,291,138 is that the feed of cleaning liquid is drawn by suction to a cross tube with teeth like projections that is centrally located within the nozzle across its width. This central location within the suction chamber with an internal space to the front and rear walls of the nozzle, causes any cleaning liquid discharged from the teeth like projections to be immediately lost to suction on either side of the cross tube. As the normal operation of cleaning heads is a forward and backwards movement a substantial portion of cleaning liquid is lost before it has time to thoroughly penetrate and dissolve any dirt or soils on the fibres of the surface being cleaned.

An additional difficulty with the suction type cleaning heads or nozzles disclosed in British Patent Applications Nos. 1,121,225 and 1,291,138 is that incoming air is continuously drawn into the nozzle during normal operations from beneath both the front and rear walls which has an immediate cooling effect reducing the efficiency of higher temperature cleaning liquids that are delivered centrally. A still further difficulty with the suction type cleaning head or nozzle disclosed in United Kingdom Patent Application Nos. 1,121,225 and 1,291,138 is caused by the close proximity of the suction outlet to the centrally located cross tube and teeth like projections which causes cleaning liquid to be drawn mainly from the middle limiting the effective working width to typically 125 mm for heads of this type. Such heads are therefore limited for use with lower powered domestic cleaning apparatus and for smaller floor areas due to the narrow effective working width.

A difficulty with the suction cleaning head disclosed in International Patent Application Nos. PCT/AU88/00446 and PCT/AU88/00447 is that the cleaning liquid reception chamber and the liquid delivery chamber are also both centrally located and inwardly spaced from the front and rear walls of the suction head in the same manner as the centrally located cross tube with teeth like projections previously disclosed in United Kingdom Patent Application Nos. 1,121,225 and 1,292,138. In the abovementioned International Patent Applications side walls have been provided on the liquid delivery chamber to reduce the rapid loss of cleaning liquid to the suction chambers on either side. However, as the normal operation of most cleaning heads, including suction heads, is a forward and backward movement, a substantial quantity of cleaning liquid will be removed simultaneously due to the location of suction chambers on both sides of the cleaning liquid delivery area within the cleaning head.

This reduces the cleaning effect of the liquid and in particular removes the advantage of using higher temperature liquids that require a dwell time to act upon and dissolve grease or ingrained soils from surfaces prior to removal. A further difficulty with the suction cleaning heads disclosed in International Patent Application Nos. PCT/AU88/00446 and PCT/AU88/00447 is caused by the baffles in the form of Y-shaped or V-shaped ribs or vanes which deflect incoming air sideways within the suction chamber. These baffles are positioned substantially across the flow of air into the suction mouth which reduces the efficiency of the head due to the sudden changes of direction of the airflow and frictional losses against these restrictive surfaces. The more that power and airflow are increased the more restrictive the baffles become when compared to a cleaning head without restrictions. Typically suction heads of the kind disclosed are 200 mm or less in effective working width and are used in conjunction with smaller domestic cleaning apparatus.

A still further difficulty with these suction heads is caused by the presence of an inner liquid reception chamber serving as a storage reservoir within the cleaning head. Whenever the accompanying source of suction is turned off, for example during emptying, refilling or adjustment, the contents of the inner liquid reception chamber dump by gravity flow onto the surface being cleaned in a series of over wet patches. The alternative is to drain the internal reservoir by disconnecting or shutting off the liquid supply and waiting for the contents to be drawn away with the suction source still operating which is time consuming. The present invention provides an improved and simplified cleaning head that consists of two main components and is suited for use with any form of wet cleaning apparatus or wet suction source designed to recover liquids whether used for smaller domestic or larger commercial purposes.

SUMMARY OF THE INVENTION

In accordance with one aspect of the present invention there is provided a suction cleaning head comprising a suction chamber having an open mouth and an outlet adapted to be connected to an air extraction means, a cleaning liquid chamber located at a point external to the suction chamber and having an open mouth and an outlet adapted to be connected to a supply of cleaning liquid, a flow restricting means adapted to engage the open mouth of the cleaning liquid chamber, and a plurality of passage ways to enable transfer of cleaning liquid from the cleaning liquid chamber through or past the flow restricting means. The suction chamber and cleaning liquid entry chamber preferably share a common wall.

The liquid flow passageways may be formed in the flow restricting means. Alternatively, the liquid flow passageways may be formed as recesses or grooves in one or more walls of the liquid entry chamber. Still further the liquid flow passageways may be present in both the flow restricting means and walls of the liquid entry chamber. The flow restricting means is preferably adapted to fit over the open mouth when engaged therewith in a first embodiment of the present invention but may alternatively be received solely within the open mouth as in a second embodiment of the present invention.

The flow restricting means prevents movement of the cleaning liquid from the cleaning liquid chamber except through the liquid flow passageways provided in either or both the flow restricting means and mouth of the cleaning liquid chamber.

BRIEF DESCRIPTION OF THE DRAWINGS

The present invention will now be described by way of example, with reference to the accompanying drawings, in which:

FIG. 14 is a cross-sectional side elevation of the suction cleaning head of FIG. 9 having a different flow restricting means fitted therein;

FIG. 15 is a perspective view of the flow restricting means of FIG. 14;

FIG. 19 is a perspective view of the flow restricting means of FIG. 18;

FIG. 20 is a cross-sectional side elevation of the suction cleaning head and flow restricting means of FIGS. 18 and 19;

DESCRIPTION OF THE INVENTION

Figure 1:
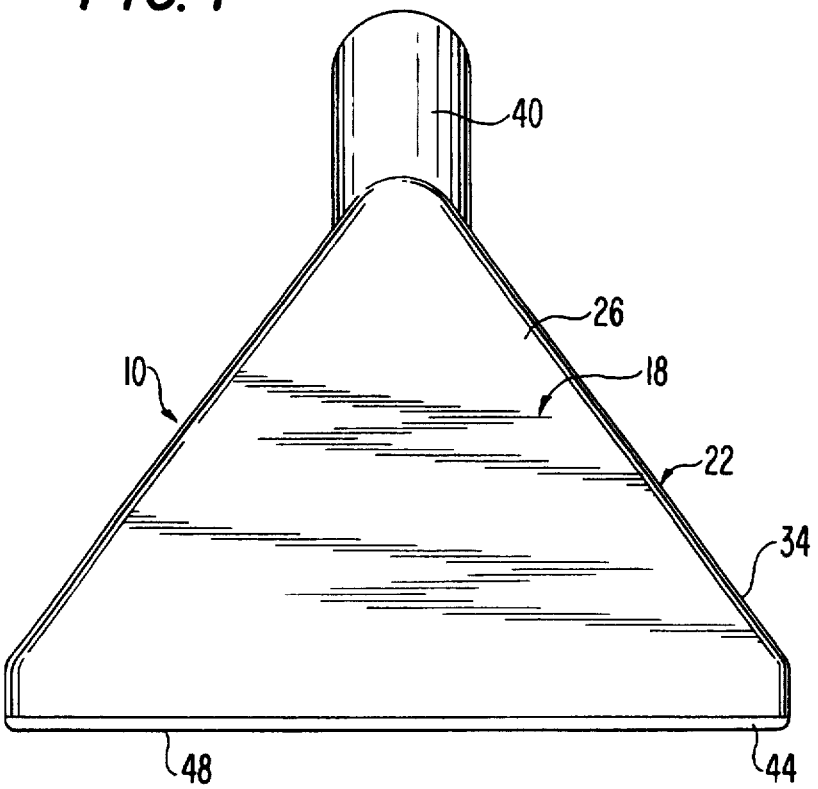
FIG. 1 is a front view of a suction cleaning head in accordance with a first embodiment of the present invention.
Figure 2:
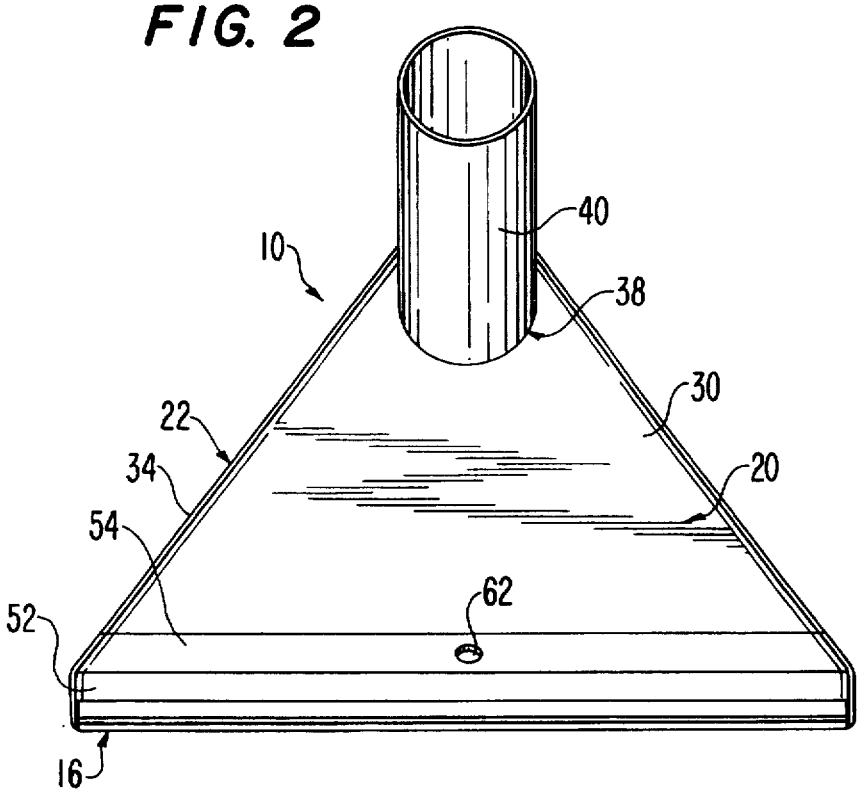
FIG. 2 is a rear view of the suction cleaning head of FIG. 1.

In FIGS. 1 to 8 there is shown a suction cleaning head 10 in accordance with a first embodiment of the present invention. The suction cleaning head 10 comprises a suction cheer 12, a cleaning liquid chamber 14 (hereinafter referred to simply as the liquid chamber 14) and a flow restricting means 16 which typically includes a closure and passageways, as will be subsequently explained.

The suction chamber 12 is defined by a forward wall 18, a rear wall 20 and side walls 22. The forward wall 18 has an inner face 24 and an outer face 26. The rear wall 20 has an inner face 28 and an outer face 30. Similarly, the side walls 22 have inner faces 32 and outer faces 34. The walls 18, 20 and 22 of the suction chamber 12 define an open mouth 36.

The walls 18, 20 and 22 meet at a point remote from the open mouth 36 to form an outlet port 38 from which extends a suction hose connecting means 40. The connecting means 40 is adapted to receive a detachable tubular handle (not shown) which may be connected via a flexible suction hose to a wet suction source designed to recover liquids (not shown).

A lower edge 42 of the forward wall 18 has provided thereat a forwardly projecting and elongated foot 44. The side walls 22 each have a lower edge 46 located in the same plane as a lower surface 48 of the foot 44. The rear wall 20 has a lower edge 50 spaced upwardly from the plane of the lower surface 48 of the foot 44 and the lower edge 46 of the side walls 22, as can be best seen in FIG. 5.

Figure 5:
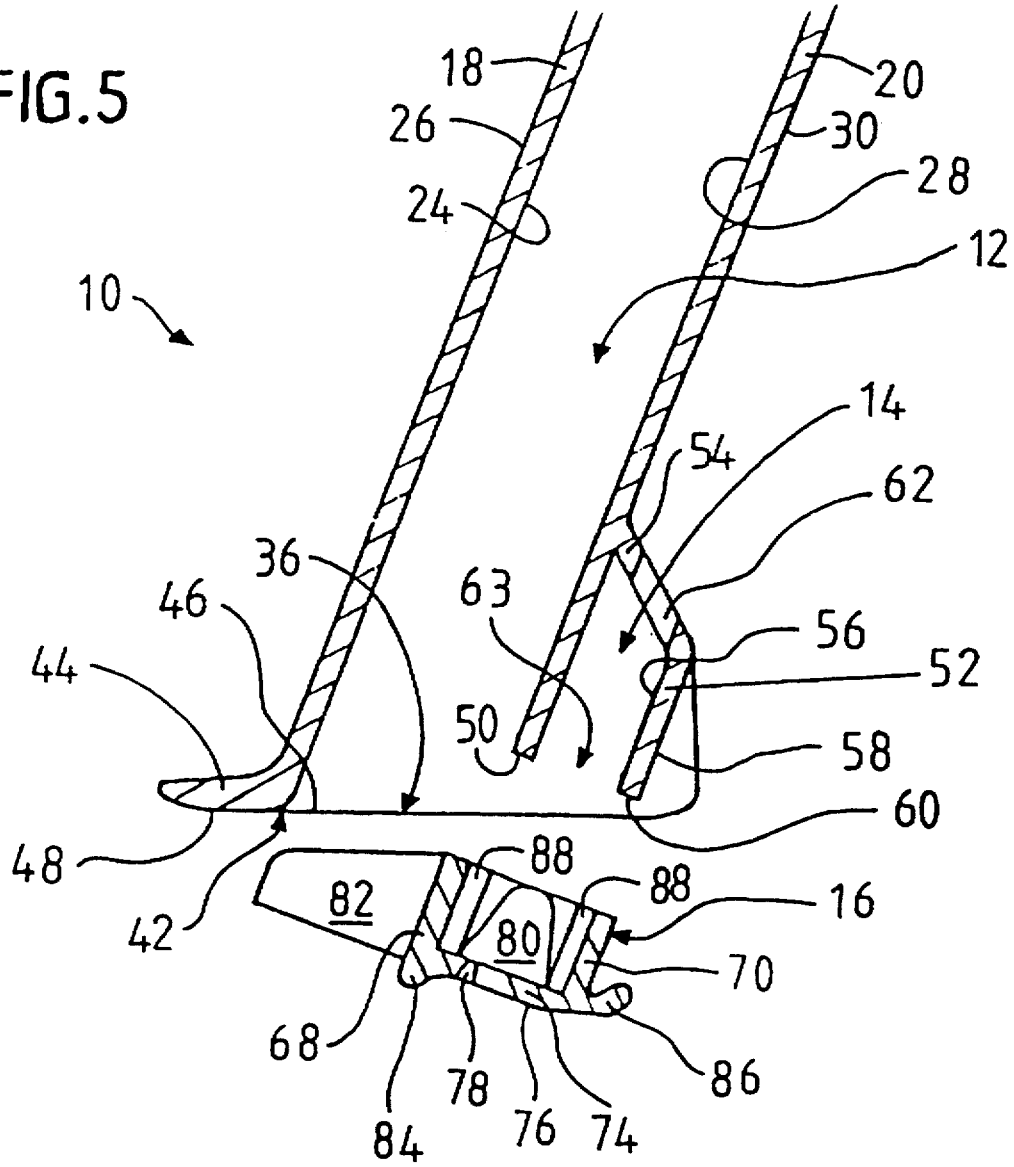
FIG. 5 is a cross-sectional side elevation of the suction cleaning head of FIG. 1 with the flow restricting means detached.

The liquid chamber 14 is defined by the rear wall 20 of the suction chamber, a rearmost wall 52, an upper wall 54 and the side walls 22, again best seen in FIG. 5. The rearmost wall 52 has an inner face 56, an outer face 58 and a lower edge 60.

The upper wall 54 has located therein a liquid entry aperture 62 capable of having connected therein or thereto a tube means (not shown) in turn connected to a source of cleaning liquid (not shown).

The walls 20, 22 and 52 define an open mouth 63. The lower edge 60 of the rearmost wall 52 is again spaced upwardly from the plane of the lower surface 48 of the foot 44 and the lower edges 46 of the side walls 22. However, the lower edge 60 is closer thereto than the lower edge 50 of the rear wall 20.

Figure 6:
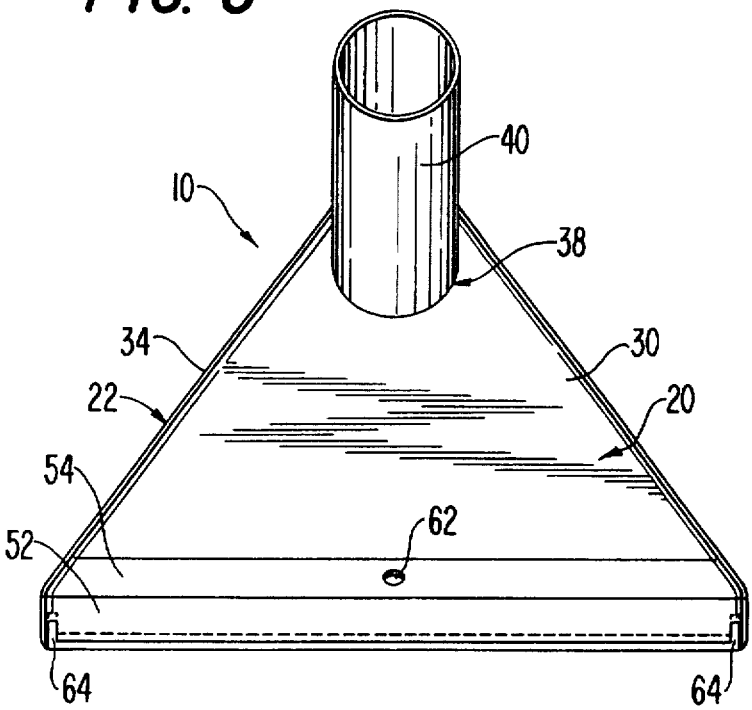
FIG. 6 is a rear view of the suction cleaning head of FIG. 1 with the flow restricting means removed.
Figure 9:
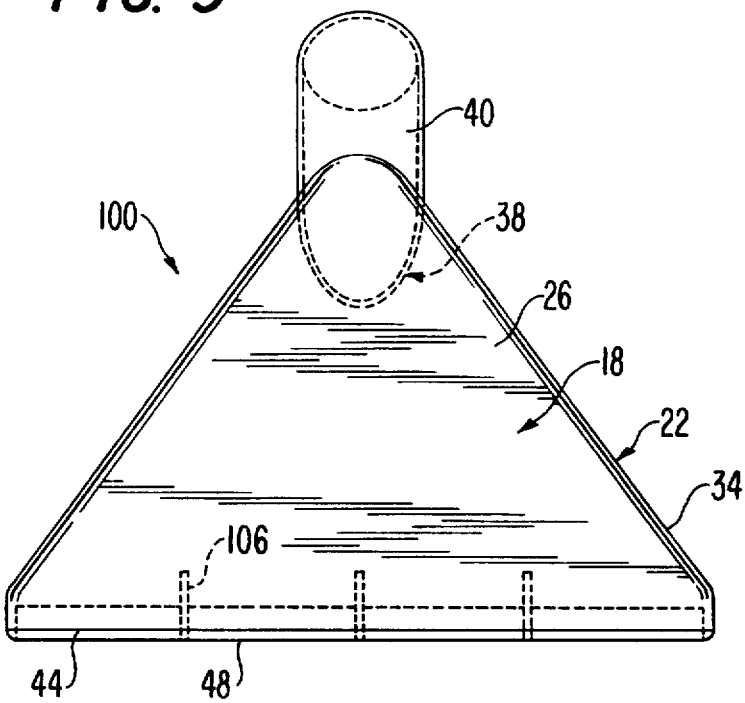
FIG. 9 is a front view of a suction cleaning head in accordance with a second embodiment of the present invention with some internal features shown in phantom.

The rear wall 20 and rearmost wall 52 have provided therein slots 64 adjacent the side walls 22, as can be seen in FIG. 6. The slots 64 allow the flow restricting means 16 to be received therein.

Figure 7:
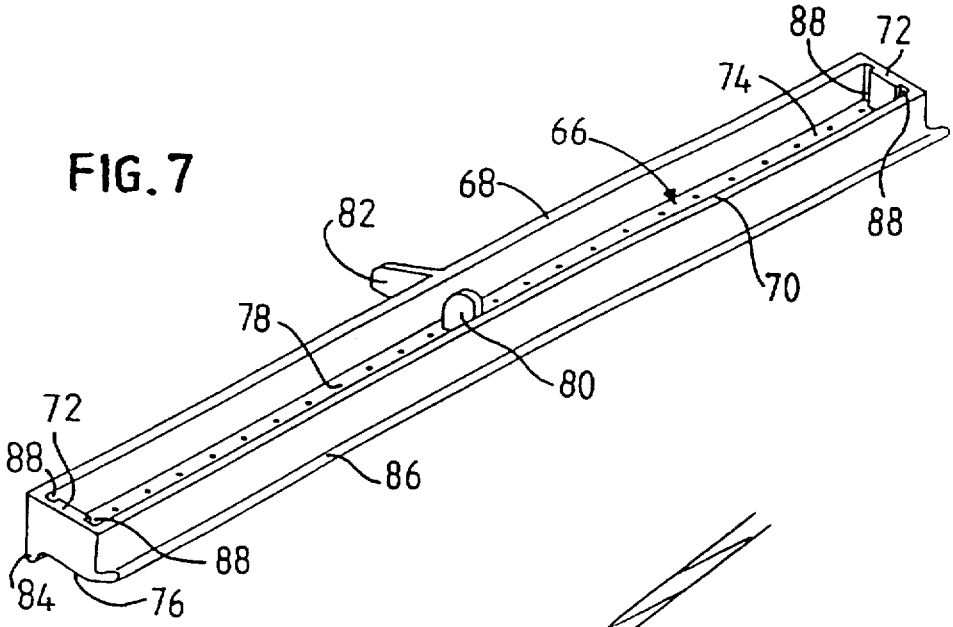
FIG. 7 is an upper perspective view of the flow restricting means of FIGS. 4 and 5.

The flow restricting means 16 comprises a base member 66, upstanding forward and rear walls 68 and 70 respectively, and side walls 72, as is best seen in FIG. 7.

The base member 66 has an upper surface 74 and a lower surface 76. A plurality of passageways 78 are provided in the base member 66 extending from the upper surface 74 to the lower surface 76. The base member 66 also has upstanding from its upper surface 74 a stud member 80. The stud 80 does not touch or interconnect with the forward and rear walls, 68 and 70 respectively.

Figure 4:
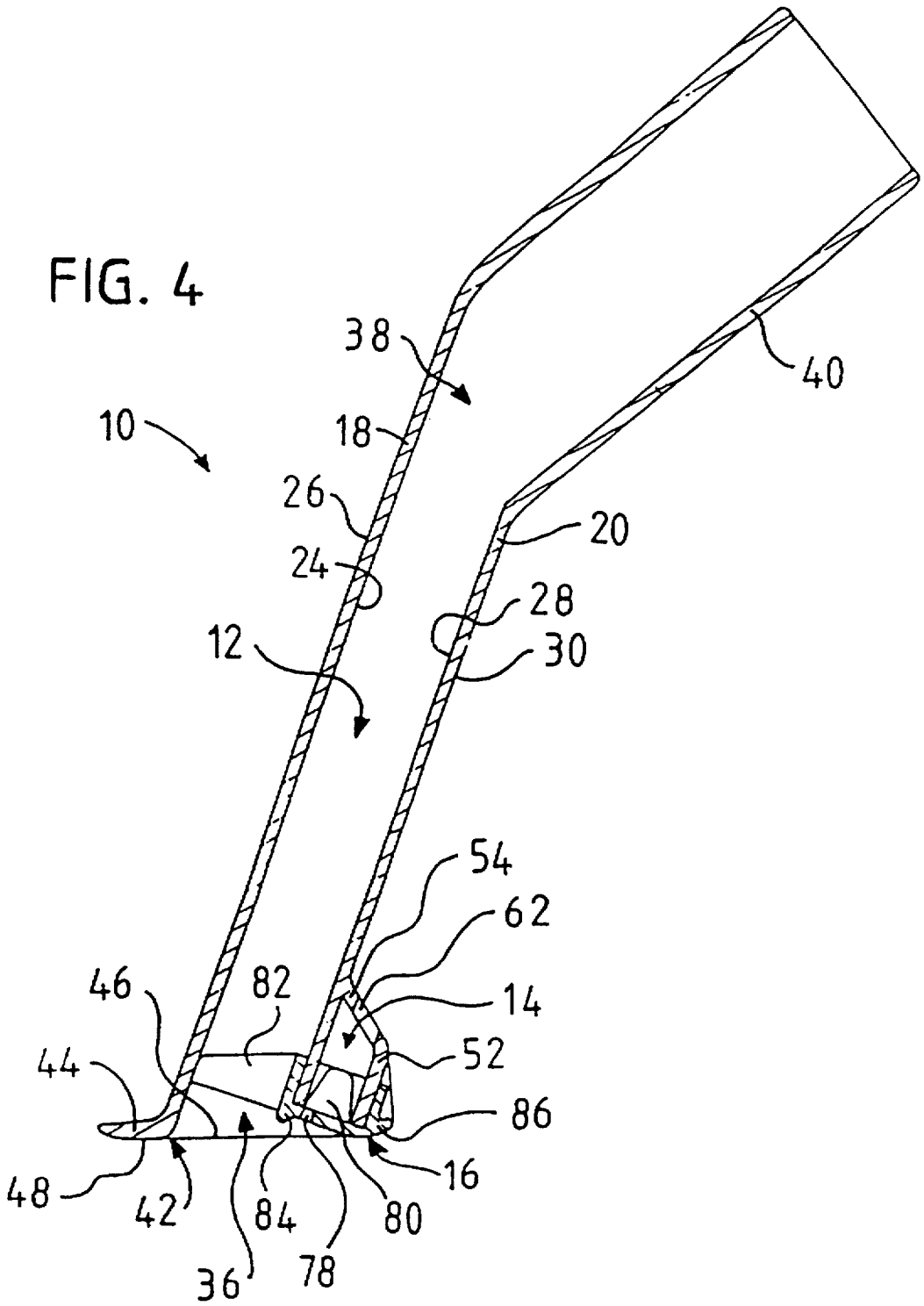
FIG. 4 is a cross-sectional side elevation of the suction cleaning head of FIG. 1.

The forward wall 68 has projecting therefrom a reinforcing member 82, as can be seen in FIGS. 4, 5 and 7. The lower surface 76 of the base member 66 has provided thereon a depending forward edge 84 and a rearwardly projecting edge 86.

Figure 8:
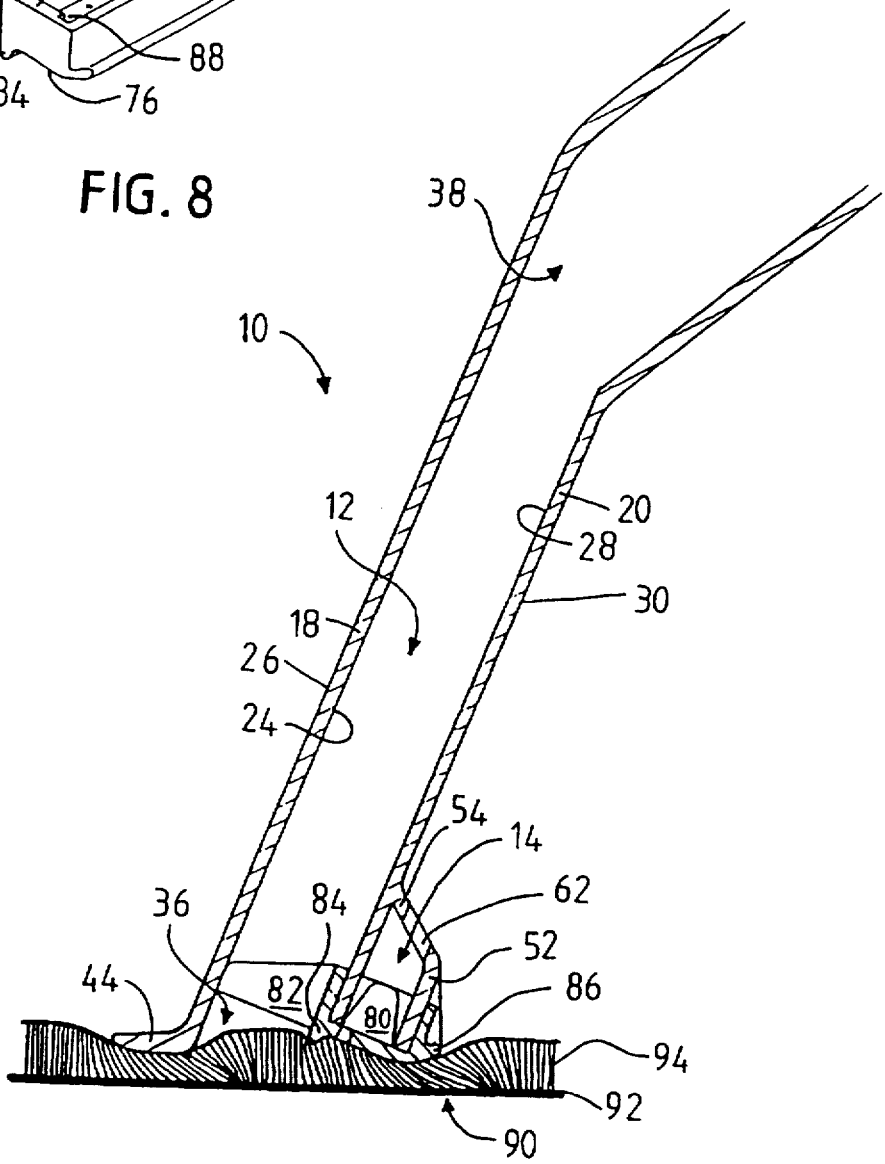
FIG. 8 is a cross-sectional side elevation of the suction cleaning head of FIGS. 1 to 4 shown in use on a carpet.
Figure 10:
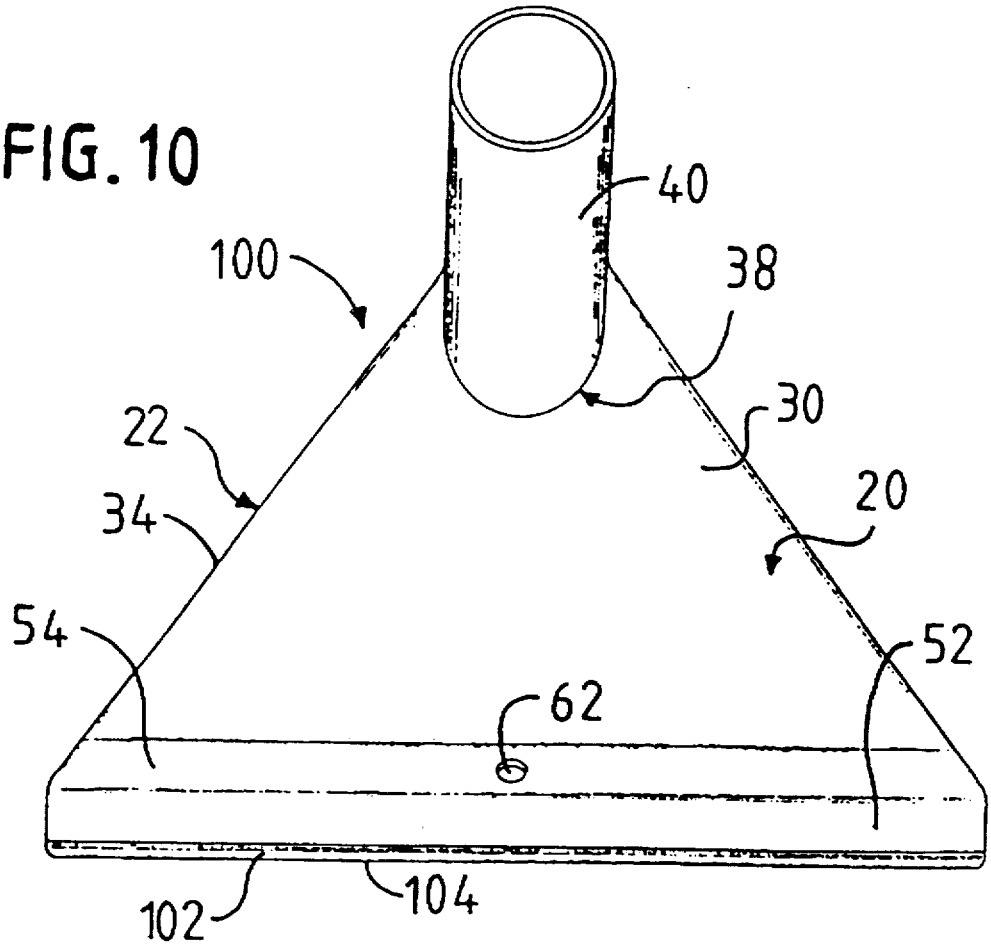
FIG. 10 is a rear view of the suction cleaning head of FIG. 9.

The side walls 72 have provided therein recesses 88 adjacent the forward and rear walls, 68 and 70 respectively. The flow restricting means 16 attaches to the liquid chamber 14 as shown in FIG. 4 and substantially encloses the same. The recesses 88 and the stud member 80 engage the rear wall 20 and rearmost wall 52. The reinforcing member 82 engages the inner face 24 of the forward wall 18. The rearwardly projecting edge 86 of the lower surface 76 lies in substantially the same plane as the lower surface 48 of the foot 44 and the lower edges 46 of the side walls 22, as can be seen in FIG. 4. The forward edge 84 of the lower surface 76 is positioned upwardly from this plane. In FIG. 8 there is shown the suction cleaning head 10 in use on a carpet 90. The carpet comprises a base 92 and fibres 94 projecting therefrom.

In FIGS. 9 to 22 there is shown a suction cleaning head 100 in accordance with a second embodiment of the present invention. The suction cleaning head 100 is in part the same as the suction cleaning head 10 and like numerals denote like parts.

The flow restricting bar 16 is not present in the suction cleaning head 100. The rearmost wall 52 has provided at its lower edge 60 a rearwardly projecting foot 102 having a lower surface 104. The lower surface 104 lies in substantially the same plane as that defined by the lower surface 48 of the foot 44 and the lower edges 46 of the side walls 22, as can best be seen in FIG. 12.

The position of the lower edge 50 of the rear wall 20 in the suction cleaning head 100 is substantially equivalent to that of the forward edge 84 in the suction cleaning head 10 with the flow restricting means 16 attached thereto. The inner face 24 of the forward wall 18 has located therein a number of recesses 106 that extend from the lower edge 42 thereof. The inner face 28 of the rear wall 20 also has located therein a corresponding number of recesses 108 extending from the lower edge 50 thereof.

Figure 11:
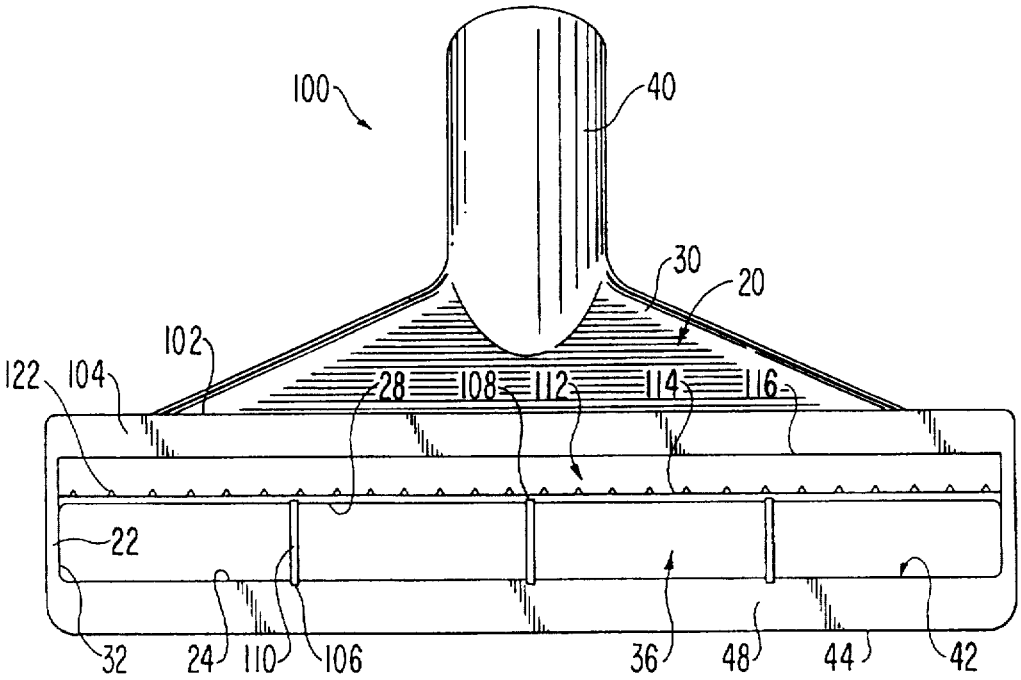
FIG. 11 is a bottom plan view of the suction cleaning head of FIG. 9.
Figure 12:
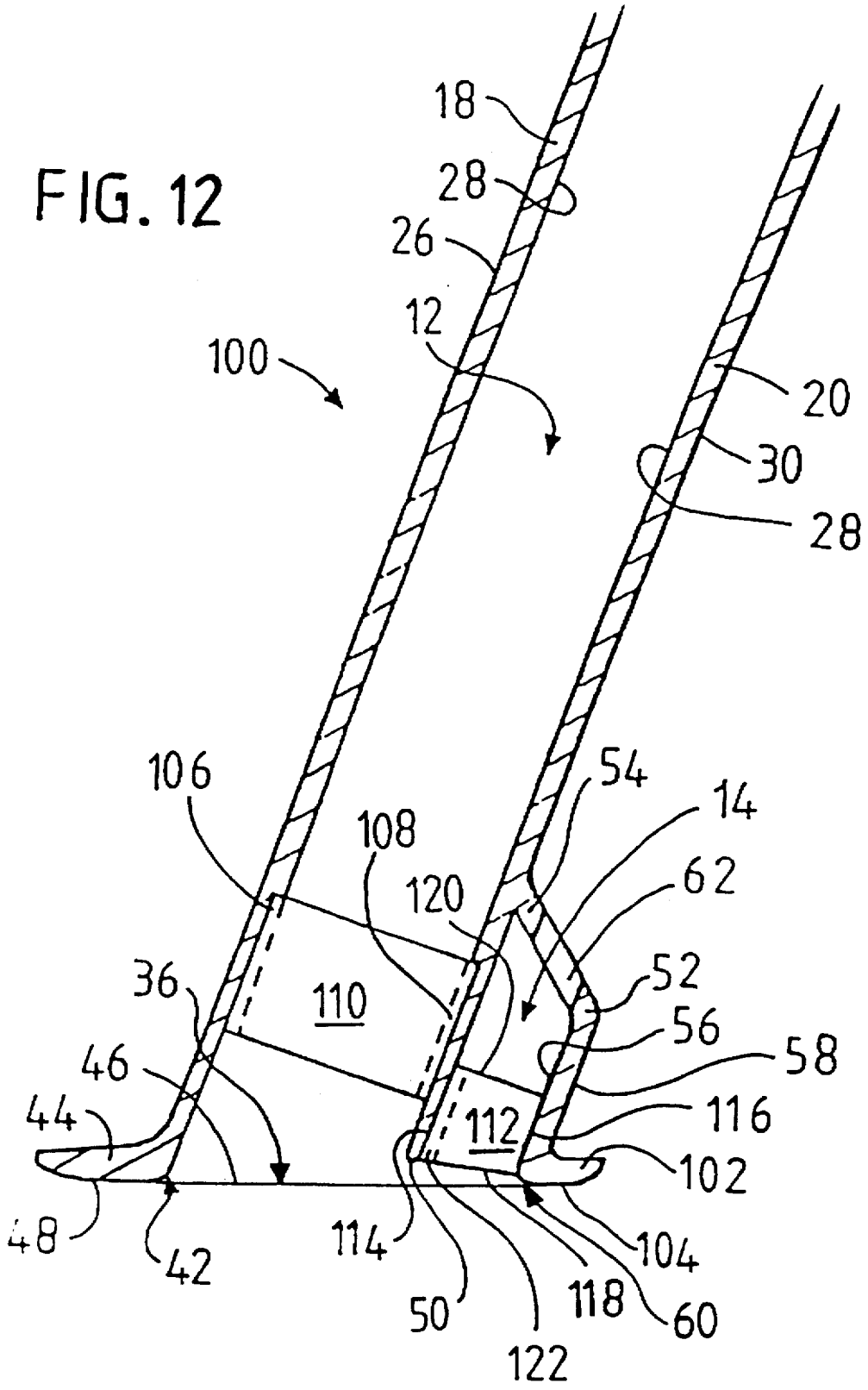
FIG. 12 is a cross-sectional side elevation of the suction cleaning head of FIG. 9.

A spacer means 110 is received in corresponding pairs of recesses 106 and 108, as can be best seen in FIGS. 11 and 12. The spacer means 110 thereby spaces the walls 18 and 20 apart.

A flow restricting means 112 is provided to fit into the open mouth 63 of the liquid chamber 14, as can be seen in FIGS. 11 and 12. The flow restricting means 112 has a forward face 114, a rear face 116, a lower face 118 and an upper face 120. The forward face 114 has located therein a plurality of passageways 122 extending between the lower face 114 and the upper face 120.

The flow restricting means 112 is received in the open mouth 63 in a manner such that the lower face 118 extends from the lower edge 50 of the rear wall 20 to the lower edge 60 of the rearmost wall 52, as shown in FIG. 12.

Figure 13:
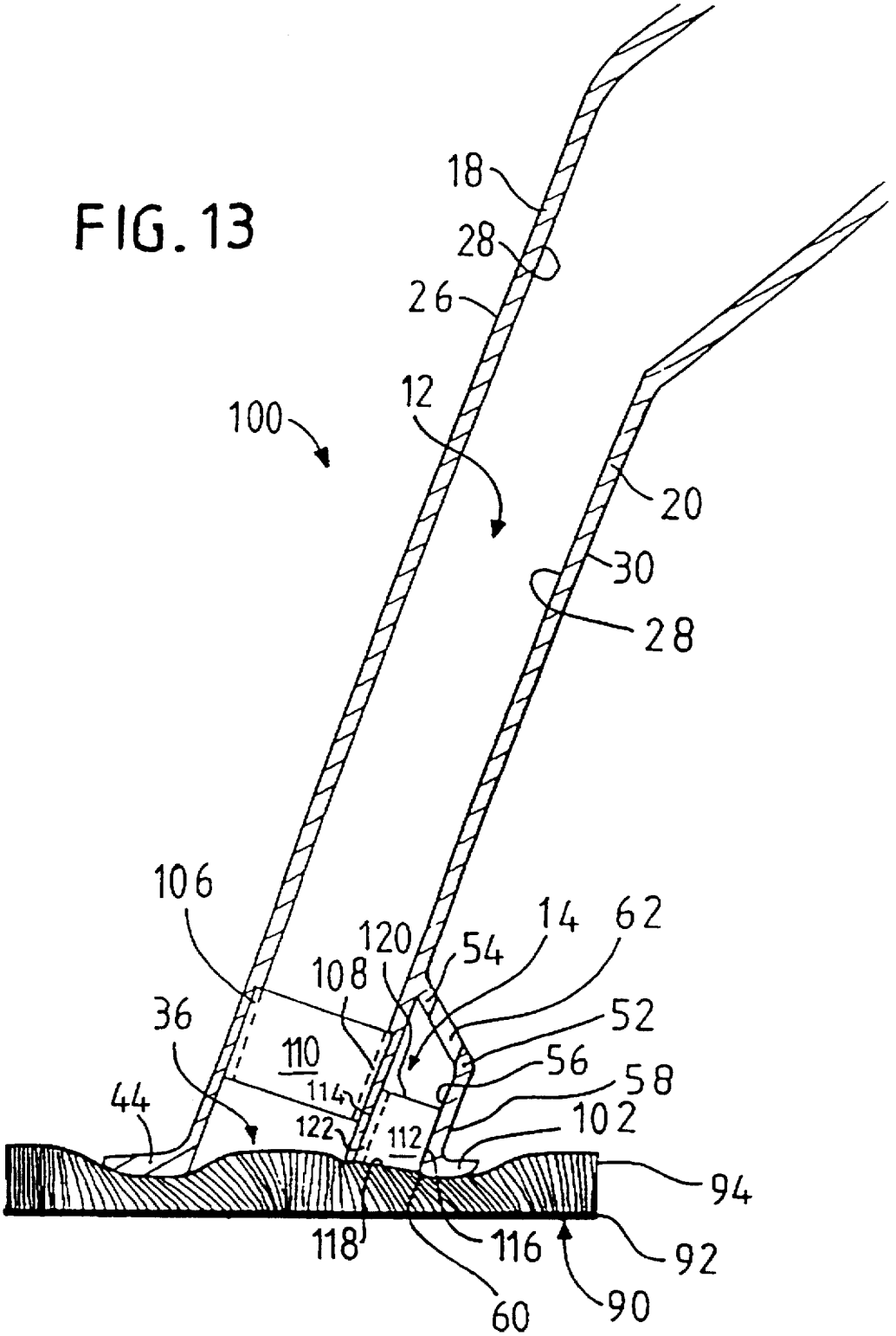
FIG. 13 is a cross-sectional side elevation of the suction cleaning head of FIGS. 9 to 12 shown in use on a carpet.

In FIG. 13 there is shown the suction cleaning head 100 with the flow restricting means 112 therein in use on the carpet 90.

In FIG. 14 there is shown the suction cleaning head 100 having therein a flow restricting means 130. The flow restricting means 130 has a forward face 132, a rear face 134, a lower face 136 and an upper face 138, as can be seen in FIGS. 14 and 15. The forward face 134 having the passageways 122 located therein as described above.

The lower face 136 extends from a point above the lower edge 50 of the rear wall 20 to substantially the lower edge of the rearmost wall 52, as is best seen in FIG. 14. The upper face 138 and lower face 136 are substantially parallel.

Figure 16:
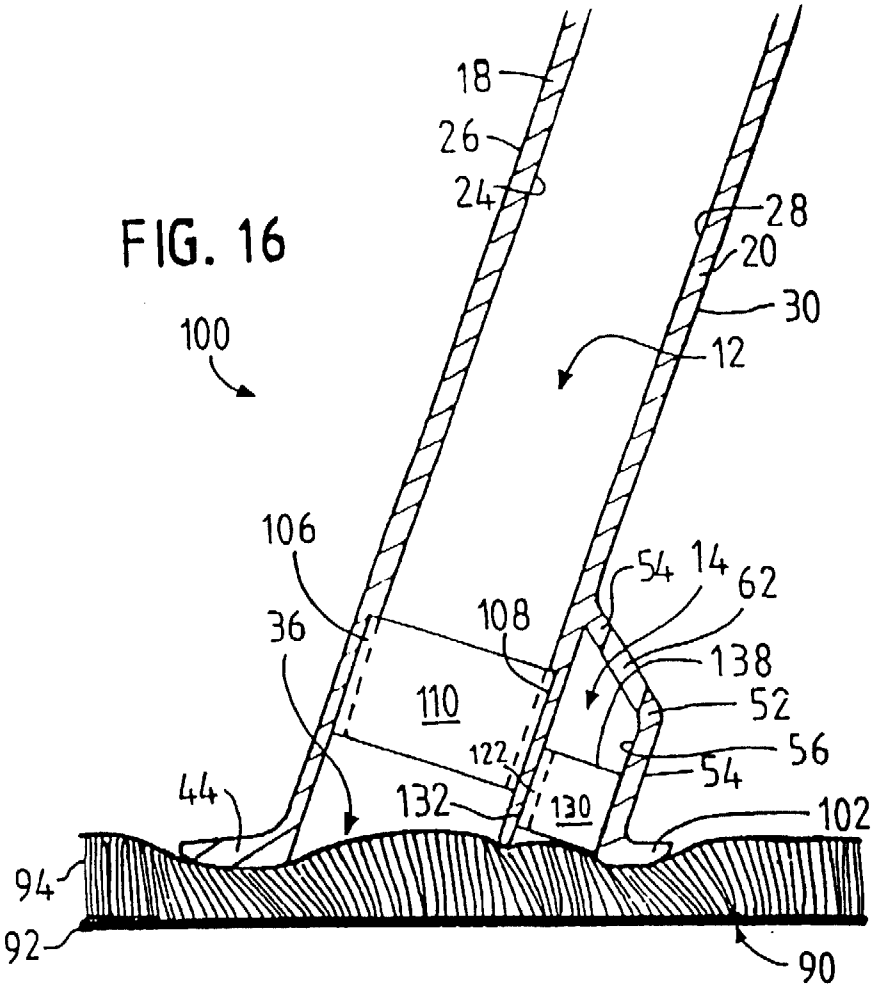
FIG. 16 is a cross-sectional side elevation of the suction cleaning head and flow restricting means of FIG. 14 shown in use on a carpet.

In FIG. 16 there is shown the suction cleaning head 100 with the flow restricting means 130 therein in use on the carpet 90.

Figure 17:
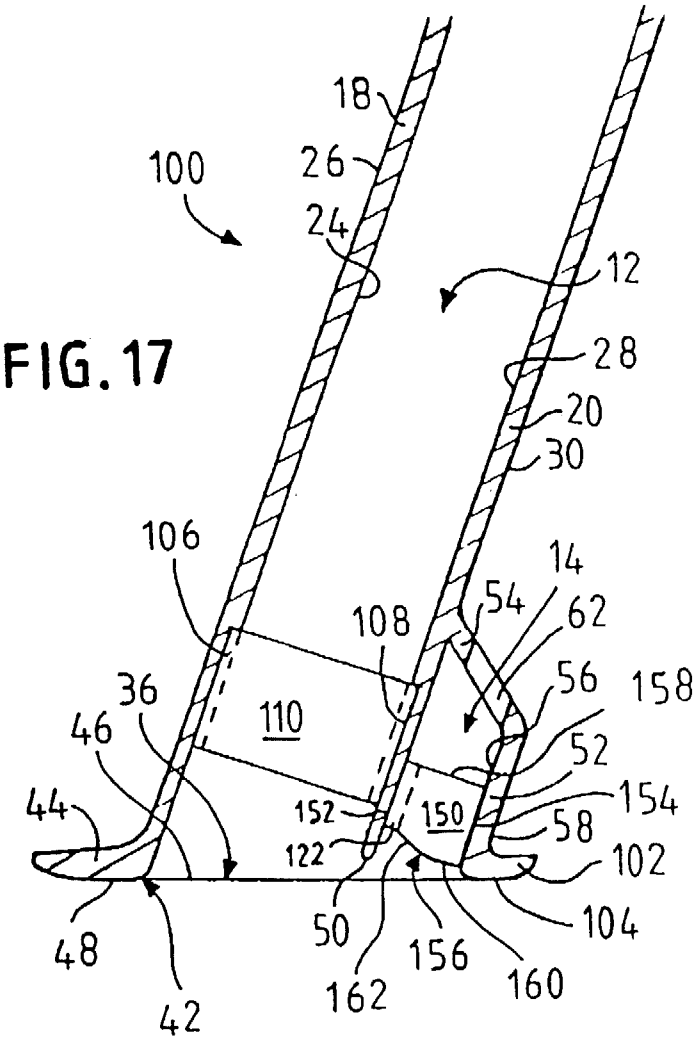
FIG. 17 is a cross-sectional side elevation of the suction cleaning head of FIG. 9 having a further different flow restricting means fitted thereto.

In FIG. 17 there is shown the suction cleaning head 100 having therein a flow restricting means 150. The flow restricting means 150 has a forward face 152, a rear face 154, a lower face 156 and an upper face 158, as shown in FIG. 17.

The forward face 152 has the passageways 122 located therein as described above. The forward face 152 is substantially shorter in length than the rear face 154. The upper face 158 is substantially straight and flat thereby the lower face 156 has a flat portion 160 and a curved portion 162. The flat portion 160 is adjacent the rearmost wall 52 and the curved portion 162 adjacent the rear wall 20, as shown in FIG. 17. The passageways 122 open into the curved portion 162 of the lower face 156. The curved portion 162 meets the rear wall 20 at a point above the lower edge 50 thereof.

Figure 18:
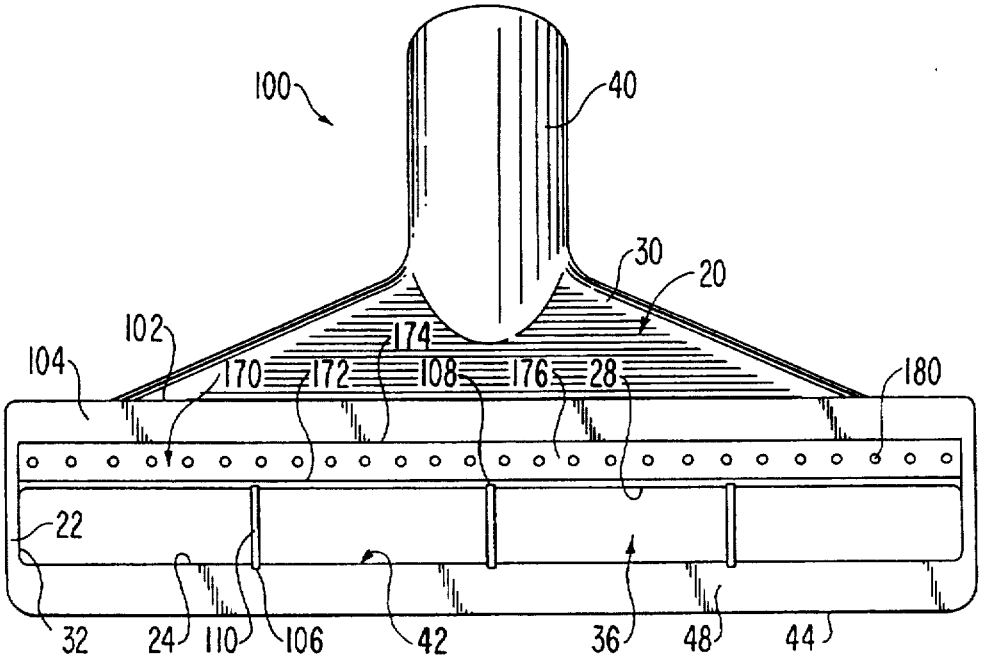
FIG. 18 is a bottom plan view of the suction cleaning head of FIG. 9 having a still further different flow restricting means fitted thereto.

In FIGS. 18 and 20 there is shown the suction cleaning head 100 having therein a flow restricting means 170. The flow restricting means 170 has a forward face 172, a rear face 174, a lower concave face 176 and an upper face 178, as shown in FIGS. 19 and 20 especially.

A plurality of apertures 180 are provided extending from the upper face 178 to the lower concave face 176 substantially midway between the forward and rear faces 172 and 174 respectively.

Figure 21:
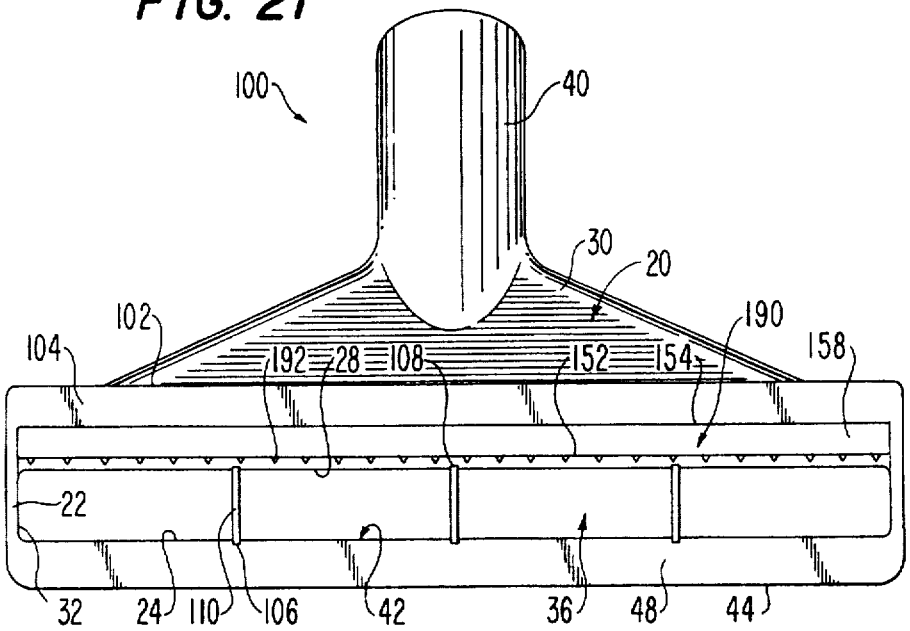
FIG. 21 is a bottom plan view of the suction cleaning head of FIG. 9 having a still further different flow restricting means fitted thereto.
Figure 3:
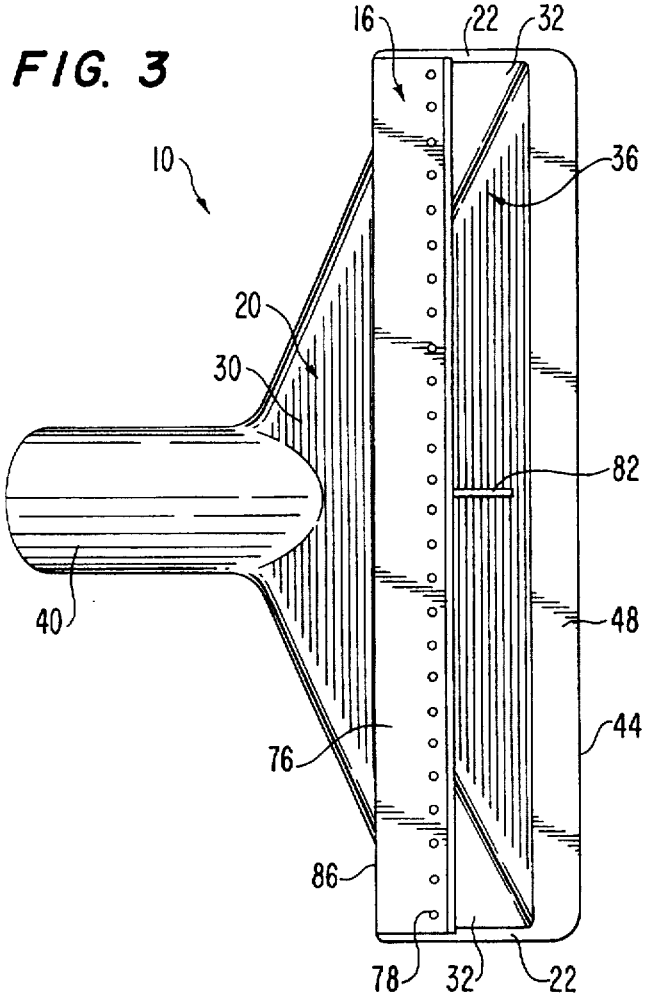
FIG. 3 is a bottom plan view of the suction cleaning head of FIG. 1.
Figure 22:
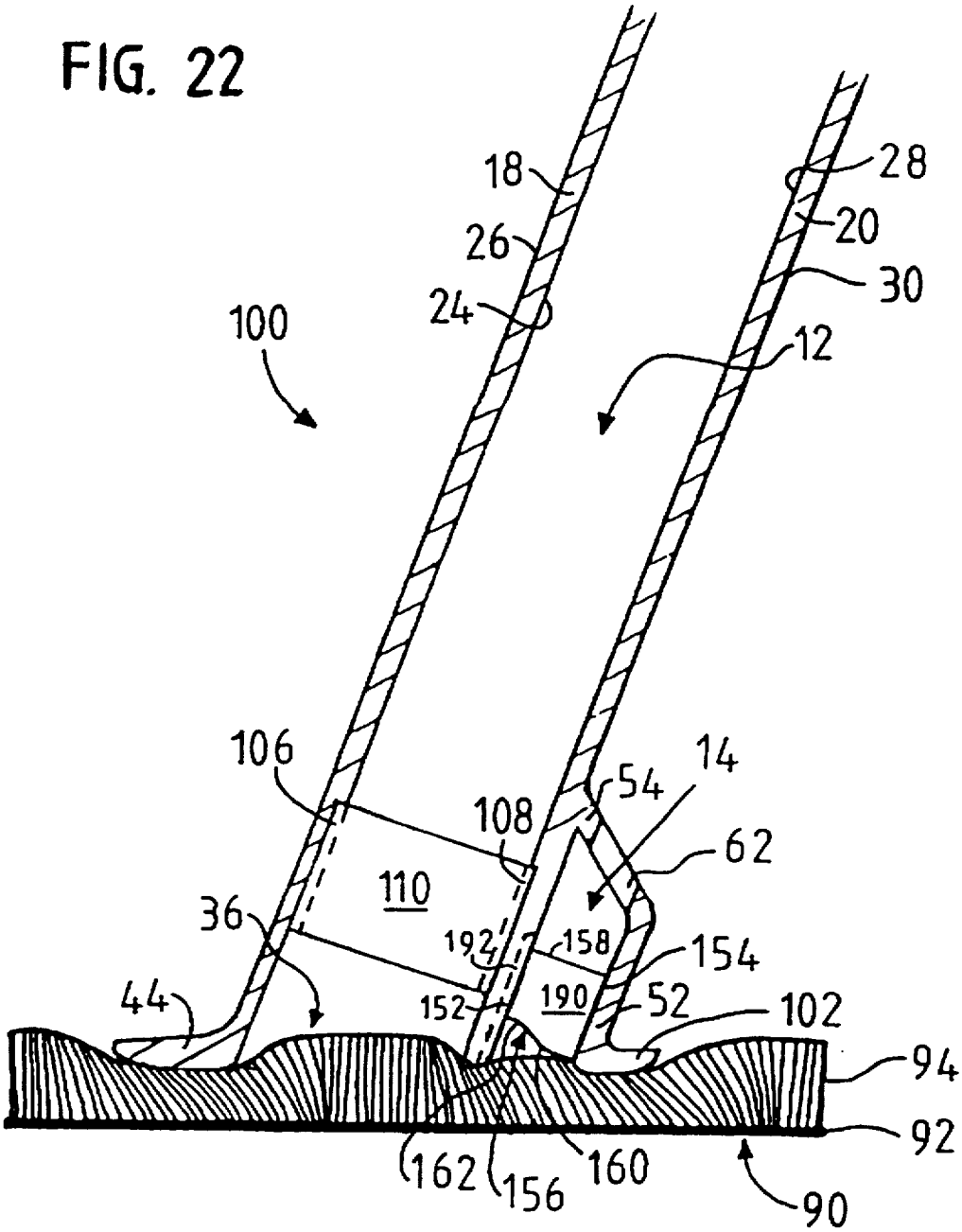
FIG. 22 is a cross-sectional side elevation of the suction cleaning head and flow restricting means of FIG. 21 shown in use on a carpet.

In FIGS. 21 and 22 there is shown the suction cleaning head 100 having therein a flow restricting means 190. The flow restricting means 190 is substantially the same as the flow restricting means 150 and like numerals denote like parts. The major difference being that the forward face 152 of the flow restricting means 190 is flat and featureless. Passageways 192 are provided in the rear face 30 of the rear wall 20 extending from a point higher than the upper face 158 to the lower edge 50 of the rear wall 20, as can be seen in FIG. 22.

In use, the suction cleaning head 10 first has the flow restricting means 16 fitted thereto by a user (not shown) so as to enclose the liquid chamber 14. The connecting means 40 is used to connect the suction cleaning head 10 to the tubular handle in turn connected to a flexible suction hose and wet suction source for the recovery of liquids.

The aperture 62 is connected to a source of preferably warm or hot cleaning liquid (not shown) via a flexible tube (not shown). The type of cleaning liquid is governed by the surface to be cleaned and the type of soiling thereon. The suction source is activated and the open mouth 36 of the suction chamber 12 placed against the carpet 90, as shown in FIG. 8. Air is drawn into the suction chamber 12 predominantly under the side walls 22. Less air enters under the foot 44 and edge 86 because of their larger surface in contact with the carpet fibres 94 and the compression thereunder.

Accordingly, a sub-atmospheric pressure zone is created within the suction chamber 12. Normal atmospheric pressure acting on the suction cleaning head 10 creates a downward force thereon. This action compresses the carpet fibres 94 and creates partial sealing under the foot 44 and edge 86. The reinforcing member 82 prevents collapse of the forward wall 18 and narrowing of the open mouth 36 whereas the flow restricting means 16 holds the rear wall 20 in position. As the suction cleaning head 10 is moved forward over the carpet 90, as shown in FIG. 8, fibres 94 are first compressed under the foot 44. The fibres 94 are uncompressed then within the open mouth 36 of the suction chamber 12. A recompression of the fibres 94 will occur under the forward edge 84 of the flow restricting means 16. The fibres 94 upon passing the forward edge 84 experience a reduced compression and preferably contact the lower surface 76 of the flow restricting means 16. The fibres 94 are subsequently recompressed under the rearwardly projecting edge 86.

The sub-atmospheric pressure created within the suction chamber 12 is transferred under the forward edge 84 to an area under the lower surface 76. This is in turn transferred to the liquid chamber 14 by the passageways 78. This causes cleaning liquid to be drawn into the liquid chamber 14.

The cleaning liquid thereby drawn into the liquid chamber 14 first collects at the junction of the upper surface 74 and the rearmost wall 52 forming a distribution channel. Once sufficient liquid has been drawn thereinto the liquid is drawn through the passageways 78 directly onto the fibres 94.

This arrangement having the passageways 78 positioned, in a linear fashion, at a point remote to the point whereat the cleaning liquid first collects upon entering the liquid chamber 14 ensures the uniform transfer of cleaning liquid to the carpet 90 across the width of the suction cleaning head 10. The passage of cleaning liquid into the liquid chamber 14 is dependent upon the internal diameter of the tubing connecting the aperture 62 and the source of cleaning liquid. The tubing is chosen so as to just fill the distribution channel. This prevents wet patches on the carpet 90 due to dumping of cleaning liquid by gravity flow upon deactivation of the wet suction source.

The fibres 94 are thereby wetted directly with cleaning liquid often absorbing the same through a capilliary action. Such wetting of the fibres 94 is characterised by absolutely minimal temperature loss in the cleaning liquid and more effective cleaning. Also, no high-pressure pump is needed as sub-atmospheric pressure delivers the cleaning liquid.

The re-compression of the fibres 94 under the edge 86 may force the cleaning liquid deeper into the carpet 90 thereby increasing cleaning efficiency. The cleaning liquid is subsequently left to "dwell" in the carpet 90 and is not immediately recovered as with prior art suction heads having liquid distribution within the suction chamber. The location of the liquid chamber 14 at a point external to the suction chamber 12 makes this possible.

Upon the suction cleaning head 10 again passing over the area on either a forward stroke or a back stroke the cleaning liquid will be drawn from the carpet fibres 94 in an uncompressed state in the open mouth 36 of the suction chamber 12.

Recovery of the cleaning liquid on the backstroke is further enhanced by the lower edge 42 which is forced downward by atmospheric pressure acting on the suction cleaning head 10 which squeezes the cleaning liquid from the carpet fibres 94 before they pass beneath the lower surface 48 of the foot 44. Cleaning liquid thereby collecting on the inner face 24 of the forward wall 18 is evacuated from the suction chamber 12 by the suction force therein.

On the backstroke further cleaning liquid will be transferred to the carpet 90. This will be worked into the carpet 90 upon passing under the edge 84 and then drawn from the fibres 94 into the suction chamber 12. The combination of the short and long "dwell" time of cleaning liquid in the carpet 90 gives highly efficient cleaning thereof.

It is envisaged that the flow restricting means 16 could be set permanently in place rather than being removable as indicated, however the latter does provide advantages for cleaning of the suction cleaning head 10.

The use of the suction cleaning head 100 in combination with the flow restricting means 112, 130, 150, 170 and 190 is substantially the same as that described for the suction cleaning head 10.

The spacer means 110 located in recesses 106 and 108 prevent the narrowing of the open mouth 36 and prevent the rear wall 20 pulling away from the flow restricting means 112, 130, 170 and 190.

With reference to FIG. 13 and flow restricting means 112 the operation is altered in the following ways. The re-compression of the carpet fibres 94 under the lower edge 50 of the rear wall 20 is not substantially relieved before the fibres 94 contact the lower face 118 of the flow restricting means 112. The foot 102 thereafter compresses the fibres 94 (when referring to the forward stroke). With reference to FIG. 16 and flow restricting means 130 the operation varies in the following ways. Due to the angle of the lower face 136 and its junction with the rear wall 20 at a point above the lower edge 50 cleaning liquid tends not to be delivered directly onto the carpet 90 from the passageways 122. On denser short pile or felt non-pile type carpets a distribution cavity may be formed below the rear face 30 of the rear wall 20 and the lower face 136. This assists the distribution of cleaning liquid across a carpet 90 if heavily matted with dirt, grease or the like. It should be noted that the fibres 94 still do contact at least part of the lower face 136 of the flow restricting means 130 in a relatively uncompressed state thereby being able to accept the cleaning liquid.

With reference to FIG. 17 and flow restricting means 150 the operation is substantially the same as that for flow restricting means 130. The uncompressed carpet fibres 94 contact at least the flat portion 160 of the lower face 156 whereas the distribution cavity is formed beneath the curved portion 162 and adjacent the rear wall 20.

With reference to FIG. 20 and flow restricting means 170 the operation is substantially the same as that for flow restricting means 130. The cleaning liquid is delivered to the carpet fibres 94 through apertures 180. The distribution cavity may be formed under the concave lower face 176 of the flow restricting means 170 when used on denser short pile or felt non-pile type carpets.

With reference to FIG. 22 and flow restricting means 190 the operation is substantially the same as that for flow restricting means 150 with regard to the distribution cavity. However, cleaning liquid is delivered to the distribution cavity through passageways 192 provided in the rear face 30 of the rear wall 20.

It is to be understood that the liquid cheer 14 may be provided also on the forward wall 18. Accordingly, the procedure employed will need to be reversed to maintain cleaning efficiency.

It is further to be understood that it is preferable to not form a distribution cavity under the flow restricting means 112, 130, 150, 170 and 190 but that it may occur with denser shorter pile or non-pile felt-type carpets.

It is envisaged that for carpets such as these with limited compression the lower edge 50 of the rear wall 20 or the edge 84 of the flow restricting means 16 will need to be closer to that plane of the foot 44 and side walls 22. It is still further envisaged that the rear wall of the suction chamber is spaced well away from the front wall, preferably at least 20 mm or greater to create a much larger area at the suction mouth than conventional cleaning heads previously disclosed in prior art, which typically have a narrow gap of 10 mm or less. The advantage gained by enlarging the surface area of the suction mouth is that, during normal cleaning operations, a downward force is exerted on the cleaning head by atmospheric pressure when air is evacuated from within the suction chamber thus eliminating the need for the operator to exert downward force manually to assist recovery by squeezing excess liquids, for example, from carpet fibres. This overcomes operator fatigue when cleaning larger areas.

The present invention provides a suction cleaning head operating essentially because of the different rates of compression of the carpet fibres and variations in the resulting sealing effect in the carpet it is being used on. These variations in sealing effect are due to the varying widths and heights of the different contact surfaces of the suction cleaning head and to the extent and quantity of carpet fibres being compressed beneath them, as described previously.

Modifications and variations such as would be apparent to a skilled addressee are deemed within the scope of the present invention.

I claim:

1. A suction cleaning head, comprising:

a suction chamber having an open mouth and an outlet connectable to an air extractor;

a cleaning liquid chamber positioned externally to said suction chamber and having an open mouth and an inlet connectable to a supply of cleaning liquid, the cleaning liquid being flowable through said cleaning liquid chamber; and means for restricting the flow of the cleaning liquid through said cleaning liquid chamber, comprising:

a closure releasably engaging and at least partially closing the open mouth of said cleaning liquid chamber; and a plurality of passageways formed at least in part by said closure, said passageways being in communication with said cleaning liquid chamber and enabling the cleaning liquid to flow from said cleaning liquid chamber at a rate restricted by a dimension and number of the passageways.

2. A suction cleaning head according to claim 1, wherein the cleaning liquid chamber and the suction chamber at least in part share a common wall.

3. A suction cleaning head according to claim 1, wherein the suction chamber is defined by forward, rear and side walls meeting at the outlet at one end and forming the suction chamber open mouth at another end.

4. A suction cleaning head according to claim 3, wherein the cleaning liquid chamber is located across the rear wall of the suction chamber, the cleaning liquid chamber being defined by a rearmost wall, a plurality of side walls and the rear wall of the suction chamber.

5. A suction cleaning head according to claim 3, wherein a lower edge of the forward and side walls of the suction chamber define substantially a single flat plane.

6. A suction cleaning head according to claim 5, wherein a lower edge of the rear wall of the suction chamber and a lower edge of a rearmost wall of the cleaning liquid chamber define a plane located above and at an angle to the single flat plane.

7. A suction cleaning head according to claim 6, wherein said closure is releasably attachable over the rear wall of the suction chamber and rearmost wall of the cleaning liquid chamber to substantially enclose the cleaning liquid chamber.

8. A suction cleaning head according to claim 7, wherein said closure has a rearwardly projecting foot, a forward depending edge and a base member therebetween having a flat to mildly concave lower surface, the base member having provided therein the passageways communicating between the cleaning liquid chamber and lower surface.

9. A suction cleaning head according to claim 8, wherein the base member of said closure includes an upper surface having a stud member locatable between the rear wall of the suction chamber and rearmost wall of the cleaning liquid chamber when the closure is attached thereto.

10. A suction cleaning head according to claim 8, wherein said closure includes a distribution channel formed at a junction of the base member and the rearmost wall for the gathering of the cleaning liquid when said closure is attached to said cleaning liquid chamber.

11. A suction cleaning head according to claim 7, wherein said closure includes a reinforcing member projectable into the suction chamber to abut the forward wall thereof.

12. A suction cleaning head according to claim 3, wherein the forward wall has provided at a lower edge thereof a forwardly projecting foot being substantially flat on an underside thereof.

13. A suction cleaning head according to claim 1, wherein said closure is received within the open mouth of the cleaning liquid chamber, and the cleaning liquid chamber includes a rearmost wall provided with a rearwardly projecting foot.

14. A suction cleaning head according to claim 13, wherein the rearwardly projecting foot lies in the same plane as a plane substantially defined by a lower edge of a forward and side walls of the suction chamber.

15. A suction cleaning head according to claim 13, wherein a lower face of the closure, when fitted in the open mouth of the cleaning liquid chamber, defines a plane from a lower edge of a rear wall of the suction chamber to the rearward projecting foot of the rearmost wall, the closure having the passageways provided therein to allow the lower face to communicate with the cleaning liquid chamber.

16. A suction cleaning head according to claim 15, wherein the passageways are located adjacent the rear wall of the suction chamber, and a distribution channel for the cleaning liquid is formed by the closure means and the rearmost wall.

17. A suction cleaning head according to claim 13, wherein the suction chamber includes at least one spacer means located therein, and a forward wall and a rear wall of said suction chamber includes therein a plurality of recesses to receive the spacer means.

18. A suction cleaning head according to claim 13, wherein a lower face of the closure, when said closure is fitted in the open mouth of the cleaning liquid chamber, defines a plane from a point above a lower edge of a rear wall of the suction chamber to the rearwardly projecting foot of the rearmost wall, and the closure has the passageways provided therein allowing the lower face to communicate with the cleaning liquid chamber.

19. A suction cleaning head according to claim 18 wherein the passageways are located adjacent the rear wall of the suction chamber, and a distribution channel for the cleaning liquid is formed by the closure and the rearmost wall.

20. A suction cleaning head according to claim 13, wherein a lower face of the closure has both a flat surface and a curved surface, the closure having the passageways provided therein allowing the lower face to communicate with the cleaning liquid chamber.

21. A suction cleaning head according to claim 20, wherein the passageways are located adjacent a rear wall of the suction chamber, and a distribution channel for the cleaning liquid is formed by the closure and the rearmost wall.

22. A suction cleaning head according to claim 13, wherein a lower face of the closure has a concave surface, the closure having the passageways provided therein allowing the lower face to communicate with the cleaning liquid chamber.

23. A suction cleaning head according to claim 22, wherein the passageways are located substantially midway between a rear wall of the suction chamber and the rearmost wall of the cleaning liquid chamber, and a distribution channel for the cleaning liquid is formed by the closure and the rearmost wall.

24. A suction cleaning head according to claim 13, wherein the passageways are provided only in one of a rear wall of the suction chamber and the rearmost wall.

* * * * *